US005280904A

United States Patent [19]

Rodriguez

[11] Patent Number: 5,280,904

[45] Date of Patent: Jan. 25, 1994

[54] FOOTBALL GOAL POST AND NET DISPLAY APPARATUS

[76] Inventor: David G. Rodriguez, 5 Sandlewood, Beaumont, Tex. 77706

[21] Appl. No.: 978,928

[22] Filed: Nov. 19, 1992

[51] Int. Cl.[5] ..... A63B 67/00

[52] U.S. Cl. ..... 273/55 R

[58] Field of Search ..... 273/55 R, 55 D, 411

[56] References Cited

U.S. PATENT DOCUMENTS

| | | | |
|---|---|---|---|
| 1,857,415 | 5/1932 | Udet . | |
| 2,076,911 | 4/1937 | Monson | 273/55 |
| 2,094,890 | 10/1937 | Hoyt | 40/127 |
| 2,112,204 | 3/1938 | Young | 40/127 |
| 3,586,326 | 6/1971 | McKenna | 273/55 D |
| 3,672,672 | 6/1972 | Rubin | 273/26 A |
| 3,836,147 | 9/1974 | Shapiro | 273/55 B |
| 4,026,554 | 5/1977 | Karkoska | 273/55 D |
| 4,068,846 | 1/1978 | Forrest | 273/55 B |
| 4,344,628 | 8/1982 | Warehime | 273/411 |
| 4,437,661 | 3/1984 | Chavez | 273/55 R |
| 4,911,443 | 3/1990 | Foster | 273/55 D |
| 4,921,257 | 5/1990 | Heller | 273/411 |

*Primary Examiner*—Theatrice Brown

*Attorney, Agent, or Firm*—Guy V. Manning

[57] ABSTRACT

A display for a football goal post comprises a net spanning the space between the uprights of the goal post, the net bearing a message. The message may be advertising, spirit booster information, team identification or the like, and it may be illuminated. Trip wires laced through and attached to the net detect contact with the net by a football, indicating successful penetration of the plane formed by the uprights and therefore a score. A trip signal from switches attached to the trip wires triggers for a predetermined period a flashing, illuminated display attached to the net, such as the illuminated message or separate chase lights around the perimeter of the net.

9 Claims, 4 Drawing Sheets

FIG. 3A
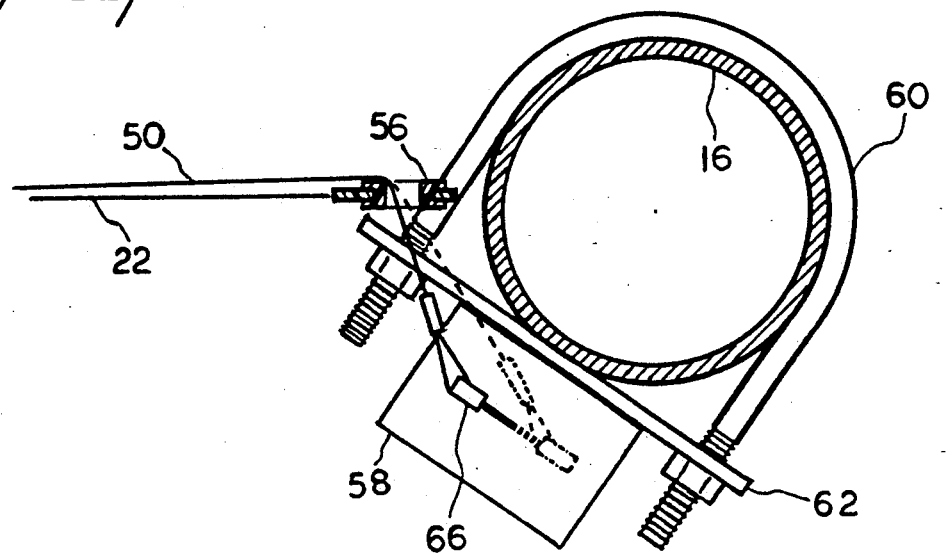
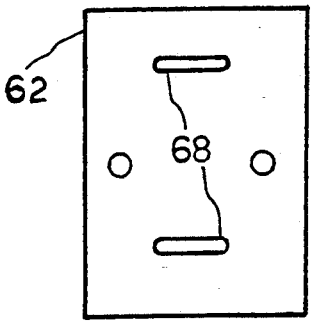
FIG. 3C
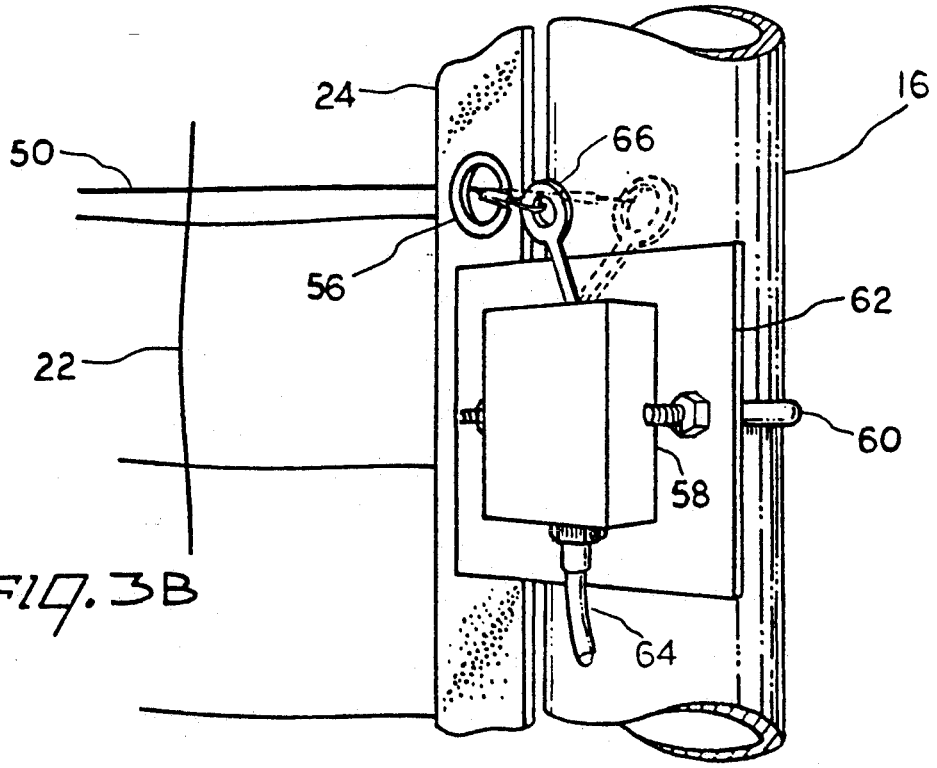
FIG. 3B

FOOTBALL GOAL POST AND NET DISPLAY APPARATUS

BACKGROUND OF THE INVENTION

1. Field of the Invention

This invention relates to improvements to football goalposts, and in particular, to an apparatus for detecting penetration of the plane between goalpost uprights by a football, indicating a score. Additionally, this invention relates to a means by which goal kicks may be conveniently prevented from flying outside the playing area and out of reach, such as into the stands behind a goalpost. Finally, this invention relates to a means by which schools may supplement revenues by leasing highly visible advertising space.

2. Description of Related Art

In judging the success of football goal kicks, such as point-after-touchdown (PAT) kicks and field goals, the football must be kicked high enough to cross the goalpost crossbar, and it must do so between two vertical uprights, to qualify as a score. Due to the relatively small size of the football and the crossbar and uprights in contrast to the usual observation distance, fans and officials alike often have difficulty detecting whether the football actually passed within the prescribed area. Even when two referees are posted directly beneath or near the crossbar, the speed of travel of the ball and its appearance against the background sky can result in divergence of opinion between them as to whether or not the kick scored. The problem is usually solved by relying upon the call, right or wrong, of one official.

Numerous devices exist to circumvent the problem. McKenna, U.S. Pat. No. 3,586,325, provides cloth panels attached around the perimeter and extending perpendicular to the plane of the uprights and crossbars to widen the apparent background against which the ball can be viewed. Though helpful, this method still depends upon careful visual observation to assure an accurate call. Karkoska, U.S. Pat. No. 4,026,554, provides a photocell field coincident with the target plane and associated electronics to detect penetration thereof and trigger a vertical message matrix to announce the successful score. Though more reliable, Karkoska bears the disadvantage of being expensive and complex, removing it from the budgetary reach of many schools. A need therefore exists for a reliable and inexpensive means of detecting successful scores through the goal post.

Professional football franchises having better funding than most schools have adopted a practice of raising a net between the goalpost and the grandstands to catch a football kicked for a PAT or field goal and to prevent it from entering the grandstands. Though footballs are expensive and unwary fans can be injured if struck by a kicked football, such nets are uncommon at high schools and colleges at least partly because of the cost to install them. A need therefore exists for a practical and inexpensive means for capturing goal kicked footballs to prevent them from entering the grandstands.

Baseball fans are accustomed to seeing advertising on outfield fences at school stadiums, but such advertising is less common in football fields, though it sometimes appears along the low perimeter wall of the grandstands. Schools derive significant revenues and advertisers derive significant exposure from such advertising even though the viewing time usually is limited to sporting events. Advertisers likely would be attracted to significantly higher visibility message media at such events, but few exist, the notable exception being electronic scoreboards at better funded institutions. Schools of lesser means have little more to offer than billboards standing around the premises. A need therefore exists for an inexpensive means of providing highly visible advertising, creating an attractive exposure medium for advertisers and a welcome revenue source for budget-conscious schools.

SUMMARY OF THE INVENTION

Accordingly, it is an object of this invention to provide a reliable and inexpensive score detection apparatus for detecting PAT's and field goals.

It is another object of this invention to provide an inexpensive means for preventing kicked footballs from entering the grandstands at football stadiums.

It is yet another object of this invention to provide a highly visible message medium within the budget constraints of most institutions for advertising or spirit booster purposes.

The foregoing and other objects of this invention are achieved by providing a display for a football goalpost comprising a net spanning the space between the uprights of the goalpost, the net bearing a message. The message may be advertising, spirit booster information, team identification or the like, and it may be illuminated. Trip wires laced through and attached to the net detect contact with the net by a football, indicating successful penetration of the plane formed by the uprights and therefore a score. A trip signal from switches attached to the trip wires triggers for a predetermined period a flashing, illuminated display attached to the net, such as the illuminated message or separate chase lights around the perimeter of the net.

BRIEF DESCRIPTION OF THE DRAWINGS

The novel features believed characteristic of the present invention are set forth in the appended claims. The invention itself, however, as well as a preferred mode of use and further objects and advantages thereof, will best be understood by reference to the following detailed description of an illustrative embodiment when read in conjunction with the accompanying drawings, wherein:

FIGS. 3A and 3B detail in plan and elevational views respectively a momentary spring return switch installation as part of the penetration detection system of the present invention.

FIG. 3C details a mounting plate for the switch in FIGS. 3A and 3B.

DETAILED DESCRIPTION OF A PREFERRED EMBODIMENT

Figure 1:
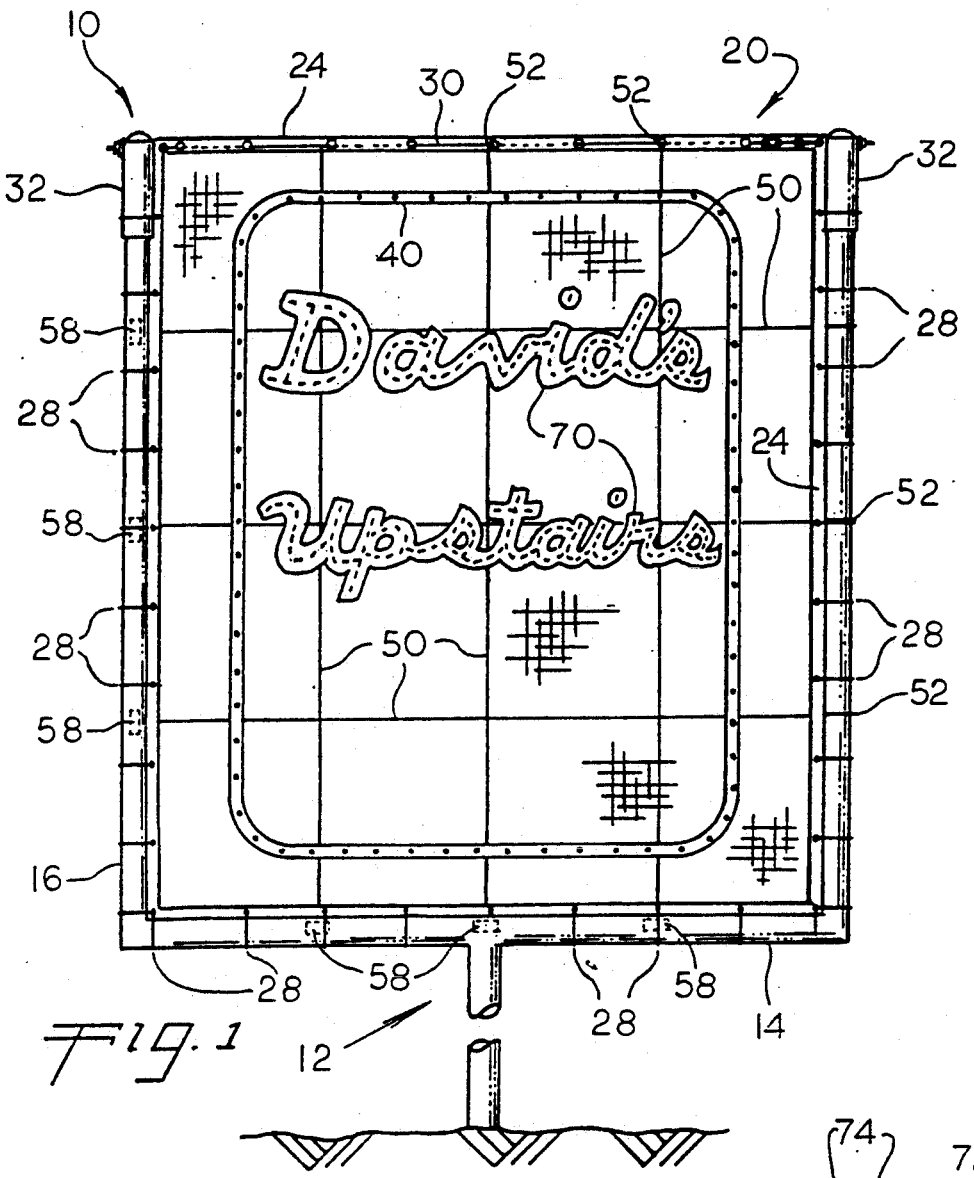
FIG. 1 depicts a front elevational view of the net installed on a typical goalpost and bearing a message.
Figure 2:
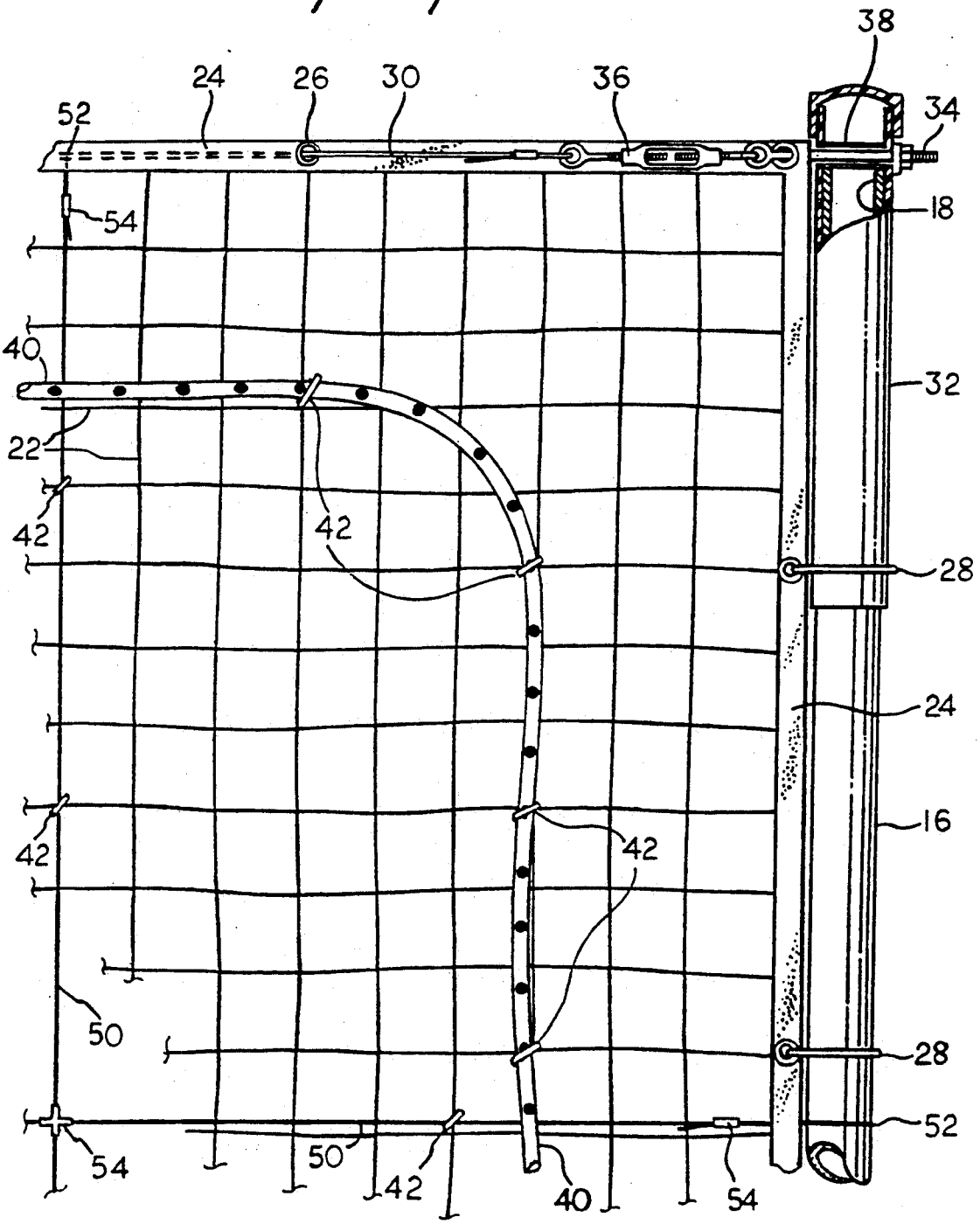
FIG. 2 shows a partial view, detailing the upper right corner, of the net in FIG. 1.

With reference now to the figures, and in particular to FIGS. 1 and 2, display 10 of the present invention is shown installed on conventional goalpost 12 having two uprights 16 extending vertically at opposite ends of crossbar 14. Display 10 comprises net 20 suspended from cable 30 extending between top ends 18 of uprights 16. Net 20 extends substantially the full width and height of the space between uprights 16, thereby covering the normal target area of a PAT or field goal, omitting, of course, the unlimited projection of the plane above cable 30, which, though considered within the target area, seldom is penetrated due to its height above ground. Net 20 bears advertising message 70 and score indicator 40 further discussed below.

Net 20 preferably comprises a four (4") inch nylon mesh 22 enclosed on all sides by border 24 having grommets 26 preferably spaced at approximately two (2) foot intervals. Cable 30 attaches to net 20 by threading through grommets 26, and net 20 is secured to uprights 16 and crossbar 14 using commonly available vinyl, locking tie wraps 28 looped through grommets 26, or by other suitable means. One having ordinary skill in the art will recognize that grommet 26 spacing and mesh 22 size may be varied significantly, and other suitable means such as tie wraps (not shown) could be employed to attach net 20 to cable 30, without departing from the scope and spirit of the present invention.

Two caps 32 secure cable 30 to the top ends 18 of uprights 16. Cable 30 is secured to caps 32 by bolts 34, and turnbuckle 36 may be provided near one cap 32 for adjusting tension in cable 30. Cable 30 is preferably one quarter (¼") inch plastic coated, stranded, stainless steel cable resistant to weathering. One having ordinary skill in the art will recognize that other cable materials and attachment means may serve the purpose without departing from the spirit and scope of the present invention.

Caps 32 preferably comprise nominally four (4") inch inside diameter (i.d.) Schedule 80 polyvinyl chloride (PVC) pipe closed at one end by suitable means such as a plug end fitting. A sleeve 38 may surround bolt 34 inside cap 32 to reinforce cap 32 against collapse under tightening pressure of bolt 34. Alternately, cable 30 simply may extend through or around cap 32 or naked top end 18 (without using cap 32) and be secured by a crimp (not shown) without departing from the spirit and scope of the present invention.

According to football goalpost standards, uprights 16 are three and one-half (3½") inch diameter pipes, so the above specified caps 32 should fit satisfactorily. One having ordinary skill in the relevant art will recognize that caps 32 can be of varying diameter or cross section to optimize the fit between the interior of caps 32 and upper ends 18 of uprights 16 without departing from the scope and spirit of the present invention. In fact, caps 32 may be dispensed with altogether if desired and cable 30 attached directly to top ends 18 of uprights 16. Caps 32 provide, however, a significant convenience while installing and replacing net 20 for maintenance and changing of message 70, as discussed further below. Being closed on their upper end, caps 32 also serve to shed rain from the end of uprights 16, enhancing their expected life.

Net 20 also bears score indicator 40 comprising a string of chase lights following the perimeter of net 20 and attached thereto by suitable attachment devices 42 such as vinyl tie wraps. A string of chase lights comprises a flexible, translucent plastic tube containing individual lights spaced along its length; wiring within the tube provides power to the lights. Indicator controller 92 (FIGS. 5A and 5B) regulates electric power to the lights to cause them to flash on and off in a sequence that gives the impression of motion propagating along the length of the light string. Suitable chase lights are available as Catalog No. SL-410 and accessories, including controller SL-110-02, from National Specialty Lighting, Inc., of Arlington, Tex, or available from Bend-A-Lite Company of Boynton Beach, Fla.

The exact location of indicator 40 and its pattern when installed is a matter of the user's preference. Indicator 40 may be a simple border supplement, as shown in FIGS. 1 and 2, or it may form characters of a message, such as "SCORE", or may comprise message 70 itself Indicator 40 preferably is not illuminated continuously, but comprises an active message means that flashes for a user-predetermined duration when stimulated to do so by controller 92 receiving a signal from a detection system indicating that a football has contacted net 20. As discussed further below, indicator 40 may alternately shine continuously and flash only in response to such contact. One having ordinary skill in the art will recognize that all such variations are within the spirit and scope of the present invention.

Detection of football contact with net 20 is achieved through a plurality of trip wires 50 spanning the target area between uprights 16. Horizontal trip wires 50 are spaced along the length of one upright 16 and anchored thereto at a fixed position by suitable means such as a wire crimp 54. In like fashion, vertical trip wires 50 are fixedly anchored to cable 30 and spaced between uprights 16. Trip wires 50 are preferably sixteen (16 ga.) gauge, monofilament, stainless steel wire commonly available. One having ordinary skill in the art will recognize that other trip wire 50 materials and attachment means may serve the purpose without departing from the spirit and scope of the present invention.

Figure 5A:
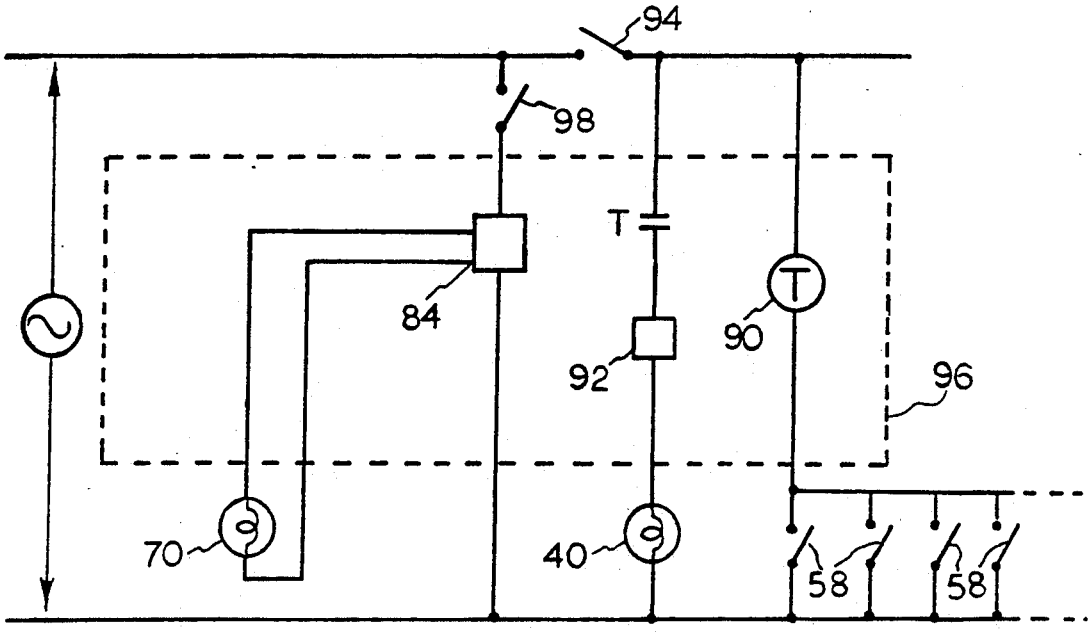
FIGS. 5A and 5B show alternative circuit diagrams of the penetration detection system of the present invention.
Figure 5B:
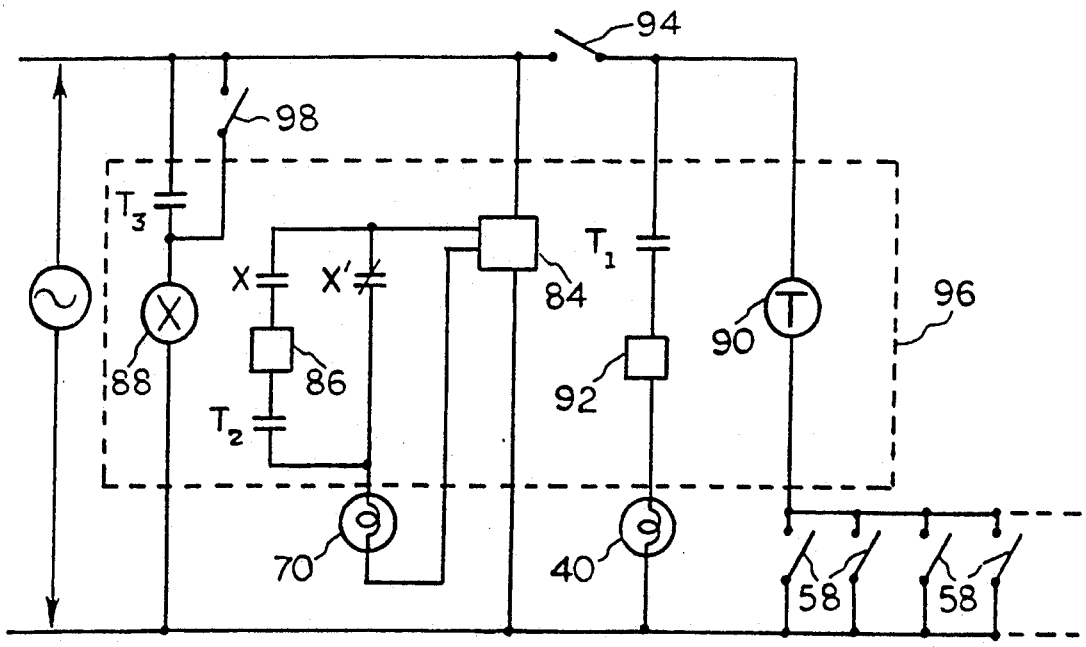

As seen in FIGS. 3A and 3B, the ends of trip wires 50 opposite their anchored ends are attached to momentary spring return switches 58 mounted to the opposite upright 16 and to crossbar 14. Each such switch 58 contains internally a spring (not shown) which biases switch 58 into a normally open position, closing only when pressure on arm 66, such as from trip wire 50, overcomes the spring to close switch 58's contacts, completing a circuit as shown in FIGS. 5A and 5B. When the pressure is released, the spring returns arm 66 to its normal position, reopening the contacts and breaking the circuit. U-bolt 60 mounts switch 58 at an angle appropriate to permit movement of trip wire 50 through eyelet 56 in response to contact by a football with net 20. Switches 58 are preferably all mounted on one upright 16 and along crossbar 14 to facilitate access thereto for maintenance and adjustment. Switches 58 are mounted on the sides of upright 16 and crossbar 14 opposite the playing field to prevent direct impact to switches 58 by a football, possibly causing a false trip indication.

Optimally, three horizontal and three vertical trip wires 50 divide net 20 into sixteen (16) smaller target areas. More trip wires 50 will provide greater assurance of a trip signal upon contact with net 20 by a football, but at the expense of greater cost and complexity. Fewer trip wires 50, by contrast, may be employed to save cost at greater risk of undetected contact. One having ordinary skill in the art will recognize that such variations are within the spirit and scope of the present invention.

Both horizontal and vertical trip wires 50 are laced through net 20 such that a substantial portion of their length is on the side of net 20 opposite the playing field. Arranged in such fashion, should a football strike net 20 between trip wires 50, net 20 will push against one or more trip wires 50, causing a trip signal even though a trip wire 50 was not hit directly. At their intersection points, horizontal and vertical trip wires 50 may be bound together using suitable means such as crimp 54, and trip wires 50 may be crimped or tied to net 20 at selected spacing using suitable attachment means 42 to increase the likelihood of detection. Should a football not contact a trip wire 50 directly, net 20 will tug on, rather that slide over, the nearest trip wire 50, thereby preventing a glancing contact from a severely angled or weakly kicked football from going undetected.

Figure 4A:
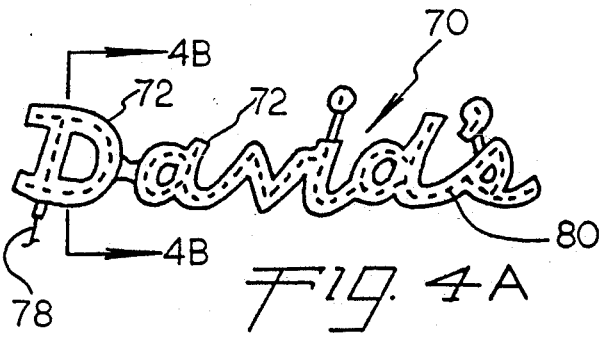
FIG. 4A shows a message assembly for attachment to the net.
Figure 4B:
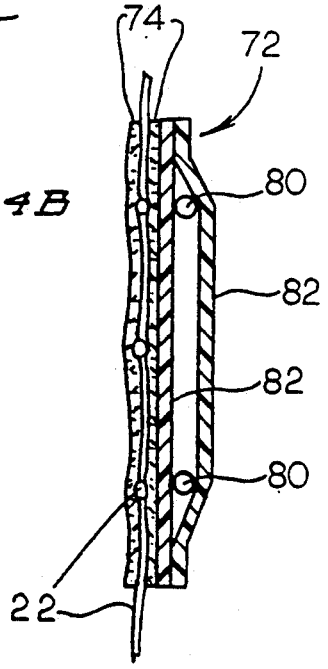
FIG. 4B details in cross section one letter of the message assembly of FIG. 4A.

Referring now to FIGS. 4A and 4B, message 70 comprises a passive message means that may be illuminated continuously. Two rows of translucent letters 72 assembled in series spell out an advertising message. Obviously, message 70 could vary, and need not be advertising, instead comprising a team or institution identification or spirit booster message. Message 70 need not comprise merely letters, but may be symbols, logos or pictures as desired. Components are selected for their weight economy to avoid inducing sag into net 20 and to minimize disruption of the view of the playing field from end zone grandstands.

Each letter 72 comprises two translucent or transparent, colored, plastic sheets 82 cut to form the shape of letter 72, sheets 82 sandwiching rope light 80 tracing the shape of letter 72. Sheets 82 preferably are sixteen (16) mil polyethylene and are heat treated to fuse together and enclose rope light 80, promoting diffusion of light from rope light 80 into letter 72 and enhancing visibility. Message 70 is assembled by stringing rope light 80 through all successive letters 72 of a given row prior to such heat treatment and stubbing out power cord 78 for connection to power supply 84 (FIGS. 5A and 5B). Where punctuation or letter separation is required, individual lights within rope light 80 may be extinguished without compromising operation. Rope light 80 preferably is three-eights (⅜") inch plastic tubing having six (6 v.) volt lights evenly spaced along its length; wiring contained within the tube provides power to the lights. Suitable rope lights 80 are available from Bend-A-Lite Company of Boynton Beach, Fla., and as Catalog No. TL-24-01, including accessories and power supply TL-24-150, available from National Specialty Lighting, Inc., of Arlington, Tex. Message 70 is attached to net 20 using hook and loop attachment devices 74, commonly known by the trade name VELCRO, glued to the back thereof, or by other suitable means.

Referring now to FIG. 5A, a preferred circuit diagram of the detection system of the present invention is shown. Any one of a plurality of normally open trip wire switches 58 may trigger time delay off relay 90. Relay 90 is selected, from a number of such time delay off relays commonly available, for the desired duration of operation of indicator 40 when a football contacts net 20. Enabling switch 94 controls power to the detection system, providing control to an operator, such as a scorekeeper, who may turn the system on and off as needed. For example, to suppress inappropriate trips due to wind currents, thrown footballs, or kick-offs, the scorekeeper may enable the system only when a PAT or field goal attempt is expected. When triggered, time delay relay 90 closes contact T, providing power to indicator controller 92, which operates indicator 40 until time delay relay 90 interrupts the power again by opening contact T. Power supply 84 remains energized, maintaining low voltage power to message 70, unless the scorekeeper opens message switch 98 to extinguinguish message 70 if required by officials to avoid distracting the kicker.

In FIG. 5B, means for switching message 70 to become part of the score detection system is shown. When relay 90 becomes energized in response to a score, contact $T_3$ closes, supplying power to message relay 88, opening low voltage contact X' and closing contact X to divert low voltage power through message controller 86 which flashes message 70 while indicator relay 90 times out. When relay 90 opens contacts $T_1$ through $T_3$, low voltage power is restored through contact X' to illuminate message 70 for normal operation. If officials require that message 70 be extinguished during the kick attempt, the scorekeeper can close message switch 98, bypassing contact $T_3$ to energize message relay 88, extinguishing message 70 immediately and diverting low voltage power to message controller 86 pending indicator relay 90 closing contact $T_2$, thereby permitting message 70 to flash in response to a score.

The foregoing structural embodiment facilitates installation of display 10 which proceeds as follows. Net 20 is spread out on a convenient horizontal surface, such as the ground near goalpost 12 or a remote manufacturing site. Cable 30 is threaded through grommets 26 at the top of net 20 and secured to caps 32 to separate caps 32 approximately the measured separation of uprights 16, within the adjustment tolerance of turnbuckle 36 if it is utilized. As discussed below, turnbuckle 36 provides the advantage of convenient adjustability to cable 30 once net 20 is lifted into place. Trip wires 50 are laced through net 20 at appropriate intervals, crimped together at their intersection points and crimped or tied to net 20 at a selected, preferably one (1 ft.) foot, spacing between crossing trip wires 50. Enough horizontal trip wire 50 is left extending beyond side borders 24 to permit anchoring one end to one upright 16 and coupling the other end to switch 58 at opposite upright 16. Vertical trip wires 50 are anchored by suitable means to cable 30 and excess wire 50 is left extending beyond bottom border 24 to couple to switches 58 installed on crossbar 14. Indicator 40 is arranged on net 20 and secured using attachment devices 42 and leads 76 are run to and down the nearest border 24 to a point on bottom border 24 convenient for coupling to leads from control box 96 (not shown, but indicated in FIGS. 5A and 5B) containing controller 92 through leads extending therefrom (not shown). Message 70 is assembled and secured to net 20 and power cords 78 run to and down the nearest border 24 to a point on bottom border 24 convenient for coupling to leads from control box 96 (not shown) containing power supply 84 using cords extended therefrom (not shown). Display 10 is then ready for installation onto goalpost 12.

At goalpost 12, display 10 is lifted into place, caps 32 are placed over top ends 18 of uprights 16 and necessary adjustments to tension in cable 30 are made, using turnbuckle 36 if provided. Tie wraps 28 are installed to secure net 20 to uprights 16 and crossbar 14. Switches 58 are mounted to one upright 16 and crossbar 14 to match the spacing of trip wires 50. Trip wires 50 are anchored to one upright 16 and then coupled to switches 58, adjusting tension in wires 50 as needed. Adjustment may be accomplished by slidably shifting switch 58 on plate 62 using slots 68 (FIG. 3C) and by rotating plate 62 by loosening and re-tightening U-bolt 60. Leads 64 and power cords 78 are coupled to corresponding wiring (not shown) from control box 96 containing controller 92 and a power supply 84. Control box 96 preferably is installed on the side of crossbar 14 opposite the playing field near one leg supporting crossbar 14. Power and control circuits (not shown) supplying control box 96 from off the playing field may then be run underground and in conduit up the leg from appropriate sources within the stadium. At this juncture, testing may proceed to verify proper tension in trip wires 50 by causing a football to contact net 20 at various angles and locations on its surface.

In foregoing fashion, display 10 may be installed simply using one or more ladders or manlifts without the need for scaffolding, thereby minimizing labor to install. To change message 70 for different advertising arrangements, the foregoing procedure may be reversed (except for removal of switches 58) to put net 20 within reach on the ground while message 70 is replaced. Then, re-installation proceeds as above, with testing minimized since tensions and trip wire 50 length already will have been established. Alternately, message 70 could be replaced using scaffolding or manlifts to access the middle of net 20 without removing net 20 from goalpost 12 or requiring retesting.

In operation, the scorekeeper closes enabling switch 94 when a PAT or field goal attempt is to be made. Message 70 illumination may be extinguished by opening message switch 98 (FIG. 5A; by closing it as in FIG. 5B) to avoid distracting the kicker. When the football is kicked, if it strikes the target area, net 20 deflects in response, stopping forward progress of the football and causing it to drop to the ground at the base of goalpost 12 instead of continuing into the stands. Such contact pushes net 20 against a trip wire 50, causing it to deflect as well. During such deflection, a length of trip wire 50 pulls through eyelet 56, pulling arm 66 of switch 58, thereby closing the trip circuit (FIGS. 5A and 5B) and triggering relay 90. Relay 90 closes contact T ($T_1$ through $T_3$ in FIG. 5B), causing indicator controller 92 to operate indicator 40 (and message controller 98 to flash message 70 as in FIG. 5B) until relay 90 times out. By this time, the spring return of switch 58 has returned arm 66 to its normal position, pulling trip wire 50 back through eyelet 56 and opening switch 58. The scorekeeper may open enabling switch 94 thereafter and restore power to message 70 if necessary.

While the invention has been particularly shown and described with reference to a preferred embodiment, it will be understood by those skilled in the art that various changes in form and detail may be made therein without departing from the spirit and scope of the invention. For example, message 70, discussed above as being illuminated using encapsulated rope lights 80, could simply be translucent symbols without internal illumination. Likewise, indicator 70 could be attached to goalpost 12 instead of net 20, or it could be supplemented or replaced by indicators located elsewhere in the stadium, such alternate indicator(s) 70 still dependent upon contact detection from display 10. Indicator 70 could be an audible as well as, or instead of, a visible display as discussed herein.

I claim:

1. A display for a football goal post, the goal post comprising a pair of uprights extending vertically from and at opposite ends of a crossbar, the display comprising a net adapted to be suspended across a space between the uprights;

attachment means, for attaching the net to the goal post, comprising two caps, each having an interior and adapted to receive within the interior an upper end of one upright;

a cable extending between the caps, the cable being attached to and adapted to support the net between the upper ends of the uprights; and a plurality of tie means around a perimeter of the net adjacent the uprights and crossbar for tying the net thereto;

passive message means for displaying a message, the passive message means comprising a plurality of translucent symbols assembled to form a message;

attachment means for attaching the symbols to the net;

a plurality of lights attached to and tracing a shape of the symbols; and power means for providing electric power to the lights; and active message means, for displaying a message in response to a stimulus, comprising flasher means, for flashing a message, comprising at least one string of chase lights attached to the net and arranged in a visible pattern;

regulator means for regulating the flash rate and sequence of the chase lights;

control means for controlling electric power to the flasher means; and trigger means for detecting the stimulus and relaying a signal to the control means for causing the control means to provide power to the flasher means for a predetermined duration.

2. An improved football goal post, the goal post comprising a crossbar supported above the ground by at least one leg and having a pair of uprights extending vertically from and at opposite ends thereof, the improvement comprising a net adapted to be suspended across a space between the uprights;

attachment means for securing the net to the goal post;

passive message means attached to the net and comprising a plurality of translucent symbols assembled to form a message;

attachment means for attaching the symbols to the net;

a plurality of lights tracing a shape of the symbols; and power means for providing electric power to the lights for continuously displaying a message; and active message means attached to the net for displaying a message in response to a stimulus, the active message means further comprising flasher means, for flashing a message, comprising at least one string of chase lights attached to the net and arranged in a visible pattern;

regulator means for regulating the flash rate and sequence of the chase lights;

control means for controlling electric power to the flasher means;

trigger means for detecting the stimulus and relaying a signal in response thereto to the control means for causing the flasher means to display the message for a predetermined duration.

3. An improved method of detecting a successful penetration of a football between the uprights of a football goal post, the method comprising providing a net substantially the size of, and adapted to be suspended within a space between the uprights;

providing a display adapted to be illuminated in response to a signal, the display comprising message means adapted to be differentially visible in response to the signal; and a controller adapted to provide electric power for illumination of the display in response to the signal;

providing a trip mechanism adapted to relay the signal to the controller upon contact of a football with the net, the trip mechanism further comprising a plurality of trip wires adapted to span the space between the uprights and to be anchored on one end;

a plurality of momentary spring return switches, each switch mounted to the goal post and attached to a trip wire opposite its anchored end;

relay means for relaying an electric signal to the controller upon tripping of one or more switches; then suspending the net across the space between the uprights and securing the net to the goal post; then installing the trip wires and switches between the uprights and attaching them to the net; then connecting the relay means to the controller for relaying a signal resulting from contact by a football with the net to the controller for causing it to illuminate the display for a predetermined amount of time.

4. A display for a football goal post, the goal post comprising a crossbar supported by at least one leg and having a pair of uprights extending vertically and at opposite ends therefrom, the display comprising a net adapted to be suspended across a space between the uprights;

attachment means for securing the net to the goal post, comprising two caps, each having an interior and adapted to receive within the interior an upper end of one upright;

a cable extending between the caps, the cable being attached to and adapted to support the net between the upper ends of the uprights; and a plurality of tie means spaced along a perimeter of the net adjacent the uprights and crossbar for securing the net to the goal post; and message means attached to the net for conveying a message.

5. A display for a football post, the goal post comprising a crossbar supported by at least one leg and having a pair of uprights extending vertically and at opposite ends therefrom, the display comprising a net suspended across a space between the uprights;

attachment means securing the net to the goal post;

active message means for displaying a message in response to a stimulus;

a plurality of translucent symbols attached to the net to form a message; and illumination means for illuminating the symbols.

6. The display according to claim 5 wherein the illumination means comprises a rope light attachment to and tracing a shape of the symbols; ad power means for providing electric poser to the rope light.

7. A display for a football goal post, the goal post comprising a crossbar supported by at least one leg and having a pair of uprights extending vertically and at opposite ends therefrom, the display comprising a net suspended across a space between the uprights and having a perimeter;

attachment means for securing the net to the goal post;

passive message means secured to the net for continuously displaying a message; and active message means comprising flasher means secured to the net for flashing a message;

control means for controlling electric power to the flasher means; and a plurality of trip wires attached to the net and anchored by one end to a fixed position adjacent the perimeter of the net;

a plurality of momentary spring return switches, one each coupled to a trip wire adjacent the perimeter opposite the fixed position; and signal leads coupled to each switch for conveying a trip signal to the control means upon operation of the switch for displaying an active message in response to a stimulus to the trip wires.

8. A display for a football goal post, the goal comprising a crossbar supported by at least one leg and having a pair of uprights extending vertically and at opposite ends therefrom, the display comprising a net suspended across a space between the uprights;

attachment means attaching the net to the goal post;

passive message means attached to the net and coplanar with the uprights for continuously displaying a passive message;

active message means attached to the net coplanar with the uprights for displaying a message in response to a stimulus; and detection means for detecting the stimulus and initiating the active message means.

9. The display according to claim 8 wherein the active message means comprises at least one string of chase lights attached to the net and arranged in a visible pattern;

regulator means for regulating a flash rate and sequence of the chase lights;

control means for remotely controlling electric power to the active and passive message means.

* * * * *